US007163184B2

(12) United States Patent
Nielsen

(10) Patent No.: US 7,163,184 B2
(45) Date of Patent: Jan. 16, 2007

(54) DRIVE UNIT, PREFERABLY FOR LIFTING COLUMNS FOR HEIGHT-ADJUSTABLE TABLES, AND A LIFTING COLUMN

(75) Inventor: Jens J. Nielsen, Broager (DK)

(73) Assignee: Linak A/S, Nordborg (DK)

( * ) Notice: Subject to any disclaimer, the term of this patent is extended or adjusted under 35 U.S.C. 154(b) by 0 days.

(21) Appl. No.: 10/480,156

(22) PCT Filed: Jul. 4, 2002

(86) PCT No.: PCT/DK02/00467

§ 371 (c)(1),
(2), (4) Date: Dec. 10, 2003

(87) PCT Pub. No.: WO03/003876

PCT Pub. Date: Jan. 16, 2003

(65) Prior Publication Data

US 2004/0166977 A1 Aug. 26, 2004

(30) Foreign Application Priority Data

Jul. 4, 2001 (DK) ..... 2001 01055
May 1, 2002 (DK) ..... 2002 00665

(51) Int. Cl.
*F16M 13/00* (2006.01)

(52) U.S. Cl. ..... 248/422; 248/157; 248/161; 108/147; 108/147.11; 474/148

(58) Field of Classification Search ..... 248/125.2, 248/422, 157, 188.2, 188.4, 161; 108/147, 108/144.1, 147.11; 74/60 R, 425; 474/148, 474/144, 70, 475; 338/474, 148, 144, 70; 475/342

See application file for complete search history.

(56) References Cited

U.S. PATENT DOCUMENTS

| | | | | |
|---|---|---|---|---|
| 1,815,954 | A | 7/1931 | Opie | |
| 3,630,096 | A * | 12/1971 | Brewer | 474/132 |
| 4,754,949 | A * | 7/1988 | Fukamachi | 251/129.03 |
| 4,892,011 | A * | 1/1990 | Nishida et al. | 475/159 |

(Continued)

FOREIGN PATENT DOCUMENTS

| | | |
|---|---|---|
| EP | 0931479 | 7/1999 |

(Continued)

*Primary Examiner*—Amy J. Sterling
(74) *Attorney, Agent, or Firm*—Dykema Gossett PLLC

(57) ABSTRACT

A drive device, preferably for lifting columns for height-adjustable tables, comprising an endless chain (31) running over first and second chain wheels (16, 17) with a first chain run and a second chain run between the two chain wheels, wherein at least one chain run may be connected with a movable element in the structure in which the drive device is incorporated. The drive device comprises a stick-shaped element (5), where the chain wheels (16, 17) are mounted at their respective ends and the one chain wheel (16) is driven by an electric motor (6) via a transmission and where both the electric motor and the transmission are likewise mounted on the stick-shaped element so that the drive device essentially appears as a finished, mountable unit. The length of stroke is determined solely by the selection of the length of the drive device, just as the drive device may be constructed for a slender column profile. The drive device is moreover easy to mount.

26 Claims, 6 Drawing Sheets

U.S. PATENT DOCUMENTS 5,489,056 A 2/1996 Staschewski
5,682,825 A * 11/1997 Manner ..... 108/147
5,794,480 A * 8/1998 Schonsteiner ..... 74/425
5,819,669 A * 10/1998 Eyre ..... 108/147
5,941,182 A * 8/1999 Greene ..... 108/147
6,099,231 A * 8/2000 Levi ..... 414/462
6,120,404 A * 9/2000 Walworth et al. ..... 474/114
6,293,320 B1 * 9/2001 McGregor, II ..... 144/1.1
6,422,363 B1 7/2002 Olsson et al.
6,546,880 B1 * 4/2003 Agee ..... 108/147

FOREIGN PATENT DOCUMENTS

SE 513249 8/2000

* cited by examiner

DRIVE UNIT, PREFERABLY FOR LIFTING COLUMNS FOR HEIGHT-ADJUSTABLE TABLES, AND A LIFTING COLUMN

BACKGROUND OF THE INVENTION

1. Field of the Invention

The present invention relates to a drive device, preferably for lifting columns for height-adjustable tables, and comprising an endless chain running over first and second chain wheels with a first chain run and a second chain run between the two chain wheels, wherein at least one chain run may be connected with a movable element in the structure in which the drive device is to be incorporated. The invention moreover relates to a lifting column containing such a drive device.

2. The Prior Art

SE 513 249, MPI Teknik AB, discloses a lifting column having three members whose movement is based on an endless chain in a closed tubular profile. Two rods protruding from the respective ends of the tubular profile are secured to the chain. The two rods are secured to the outer member and the inner member, respectively, of the column, while the closed tubular profile with the chain is secured in the central member. The telescopic movement of the column is caused by a linear actuator, which is secured with its one end to a base plate in the outer member and to the top of the tubular profile with the chain. The structure performs well as far as it goes, but it requires a column of a considerable cross-section to accommodate the actuator and the tubular member with the chain arranged side by side. In addition, the movement of the column is limited to the length of stroke of the actuator. If a great travel is desired in the column, it requires an actuator having a great length of stroke, but then the mounting height of the column becomes large, as the length of stroke of the actuator is directly related to its length—great length of stroke, long actuator. The structure is not particularly easy to mount either, just as the course of force is not optimum, resulting in inexpedient moment loads.

The object of the invention is to obviate the problems outlined above.

SUMMARY OF THE INVENTION

This achieved according to the invention by a drive device of the type stated in the opening paragraph, configured as a stick-shaped element, wherein the chain wheels are mounted at respective ends, and wherein the one chain wheel is driven by an electric motor via a transmission, and wherein both the electric motor and the transmission are likewise mounted on the stick-shaped element such that the drive device essentially appears as a finished, mountable unit. The length of stroke is determined solely by the selection of the length of the drive device and is not tied to the length of stroke of an actuator, just as the drive device may be configured for a slender column profile and be made easy to mount.

The stick-shaped element may be made in two halves which may be assembled about a longitudinal plane, recesses being provided in two parts for various elements. In another embodiment, the stick-shaped element is an entity in which recesses are provided in an area up to the motor for the transmission or a part thereof as well as for the one chain wheel, which recesses may preferably be closed by a cover shield. The stick-shaped element may be moulded of plastics as well as of metal.

In an embodiment, at least the chain wheel most remote from the motor is mounted on a subelement of the stick-shaped element and is secured to it longitudinally slidably. This involves mounting advantages when mounting the chain, and it also allows an accurate chain tightening, just as it may be subsequently adjusted.

In an embodiment, the transmission is based on a planetary gear having a toothed rim with an internal toothing in engagement with a planet wheel, which is in turn in engagement with a sun wheel, said toothed rim being configured as the one chain wheel. This gives an extremely compact structure as well as a great gearing. The planetary gear has the additional advantage that it is relatively easy to integrate in the stick-shaped element. Expediently, the transmission further comprises a worm drive, where the motor shaft is formed with the worm. This is also relatively easy to arrange in the stick-shaped element. With a transmission consisting of a worm drive and a planetary gear it is possible to achieve a great gearing, which is expedient when using motors having a large number of revolutions.

In an embodiment, the worm drive and the planetary gear are connected with a chain drive, wherein the worm wheel is connected with a first chain wheel and the sun wheel with a second chain wheel. The chain drive is flat and may therefore also be incorporated relatively easily in the stick-shaped element at the side of the planetary gear and the worm drive.

A specially constructed chain tightener for the chain drive comprises at least a spring-loaded block, one end of the block being intended for engagement with the chain, the other end having a snap locking part intended for cooperation with a boss for retention of the block against the spring action. When the chain is mounted, the snap lock is released and the block is engaged with the chain by the spring force to tighten it. This is simple and allows easy mounting. Expediently, there is a chain tightener for each chain run, preferably arranged inwardly of the chain, thereby allowing the same boss to be used for holding the blocks.

In an embodiment, the electrical wire(s) is typically a wire having several conductors to the drive unit connected with the one rod. This ensures that the wire does not get jammed in operation. To guide the wire additionally, the stick-shaped element may be formed with a cavity on the side for receiving the length of the wire in excess at any time, depending on the extended position of the drive unit.

In an embodiment, the end stop positions are determined by two end stop switches, preferably mounted on a common printed circuit board which may be inserted into a slot in the rod. The rods may be utilized for activating the end stop switches, e.g. in that the rods are provided with means or constructed themselves for activation of the end stop switches. It will be appreciated that the chain may also be used for activation of the end stop switches, but the rods are preferred since they are free or essentially free of grease and their length is well-defined, whereas the chain may be stretched.

In an expedient embodiment, the rods have a U-shaped cross-section which, with the sides, extends down around the chain. This provides a good control of the rods particularly during mounting, and the U-shape simultaneously gives a good strength and rigidity.

The side of one of the rods may be formed with a longitudinal incision for the function key of the end stop switches so that in the positions between the end stops the function keys protrude into the incision, while at the end stops the side of the rail will activate the respective end stop switch, which is a simple, safe and distinct way of activating the end stop switches.

In an embodiment, a guide for the respective rod is arranged on each end of the stick-shaped element, which has advantages in terms of mounting and transport, but it is also an advantage in terms of strength since the guide prevents the rods from deflecting, as they are subjected to column loads. The rods may additionally be guided laterally by a flange on the stick-shaped element which extends into the cavity of the U-shaped rods. The rods are expediently riveted to a U-shaped link of the chain, which is simple and inexpensive.

For attachment in the structure in which the drive device is to be incorporated, the outer end of the rods may be formed with flaps which are inserted into corresponding slots and are bent or twisted. With U-shaped rods, the two sides or the back may form the basis for the provision of flaps.

A simple mounting of the motor on the stick-shaped element is achieved by a dovetail connection, said motor being preferably provided with a front cover formed with a dovetail groove and a counterpart in the stick-shaped element.

In an embodiment, at least one end of the stick-shaped element is provided with at least a boss on each side as a lateral guide in the structure in which the drive device is to be incorporated. It is evident that the structure in which the drive unit is to be incorporated may be formed with corresponding means for fixing the drive unit.

The drive device may also be provided with a rotary potentiometer for absolute positional determination of the extended position of the drive device, said potentiometer being preferably arranged in a recess in the stick-shaped element and drawn via a toothed wheel on its shaft and in engagement with the drive chain, which is simple and functional. It will be appreciated, however, that other solutions may be used, such as optical and magnetic encoders, Hall sensors, etc.

As stated initially, the invention also relates to a lifting column having at least two, preferably three, mutually telescopically slidable members equipped with a drive Las stated in claims 1–2 of the invention. The lifting column may be configured as a table leg for height-adjustable tables. It will be appreciated that the drive device may also be used as a linear actuator.

BRIEF DESCRIPTION OF THE DRAWINGS

The invention will be explained more fully below with reference to the accompanying drawings. In the drawing.

DETAILED DESCRIPTION OF THE PREFERRED EMBODIMENTS

Figure 1:
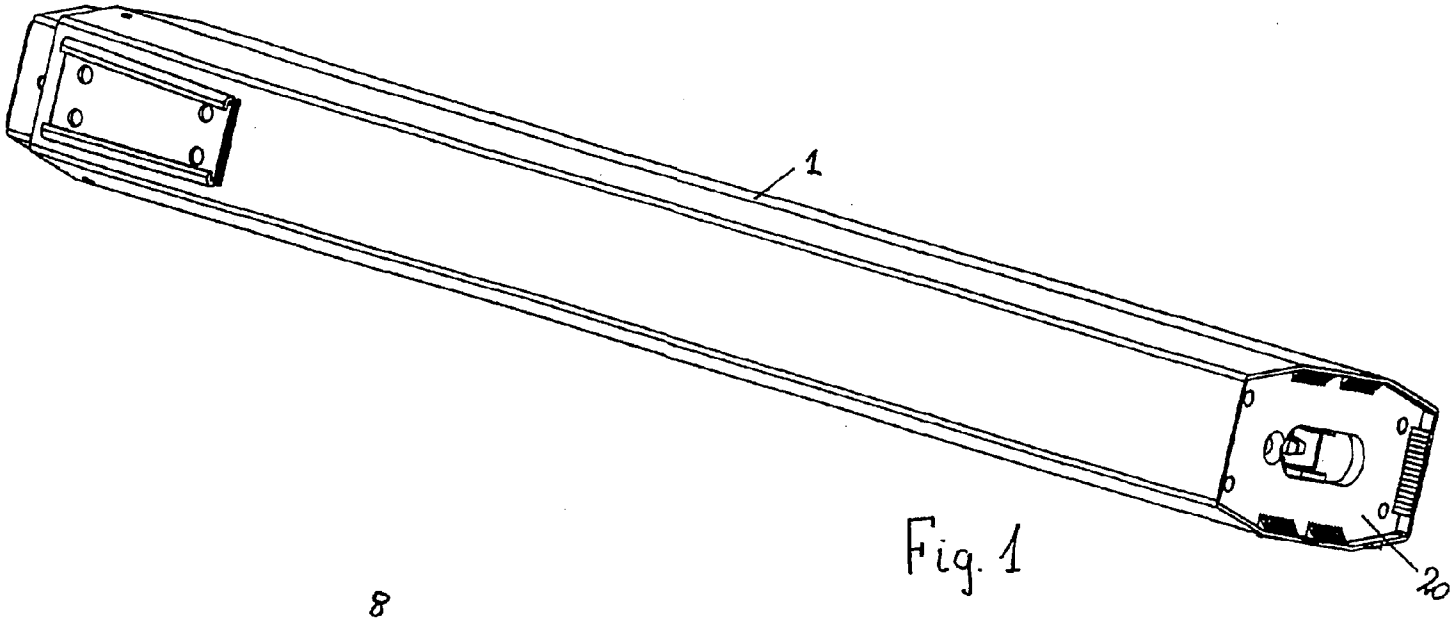
FIG. 1 shows a lifting column having three members.

The column shown in the drawings consists of three members, viz, an outer profile 1, an intermediate profile 2 and an inner profile 3.

Figure 2:
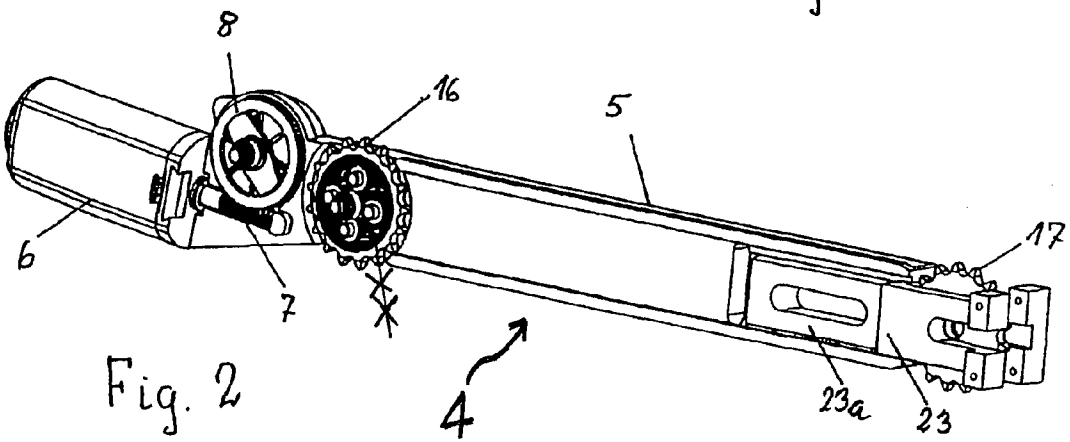
FIG. 2 shows the drive device in the lifting column of FIG. 1.
Figure 3:
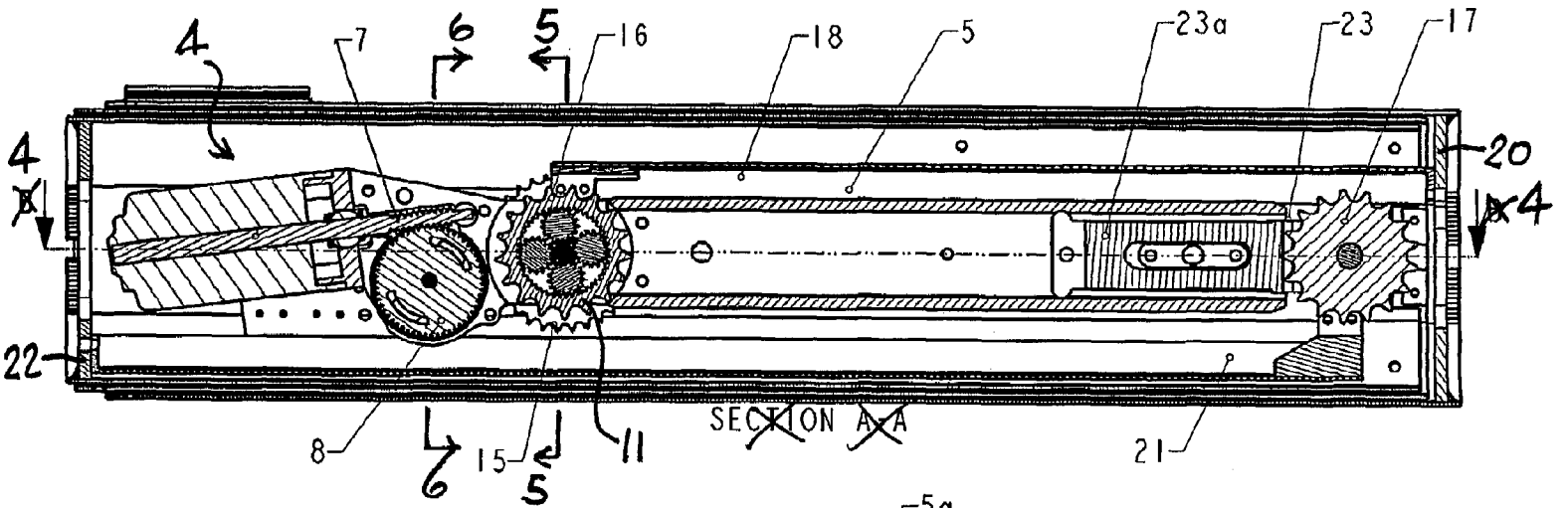
FIG. 3 shows a first longitudinal section of the lifting column of FIG. 1.
Figure 4:
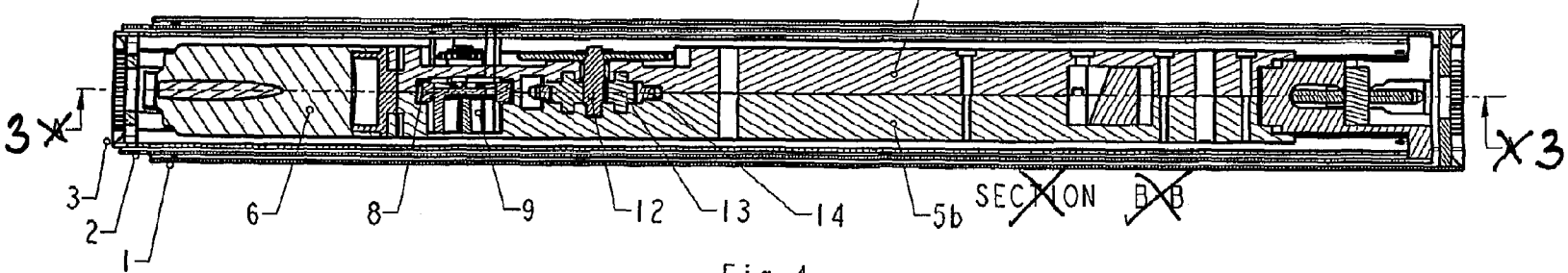
FIG. 4 shows a second longitudinal section of the lifting column of FIG. 1.
Figure 5:
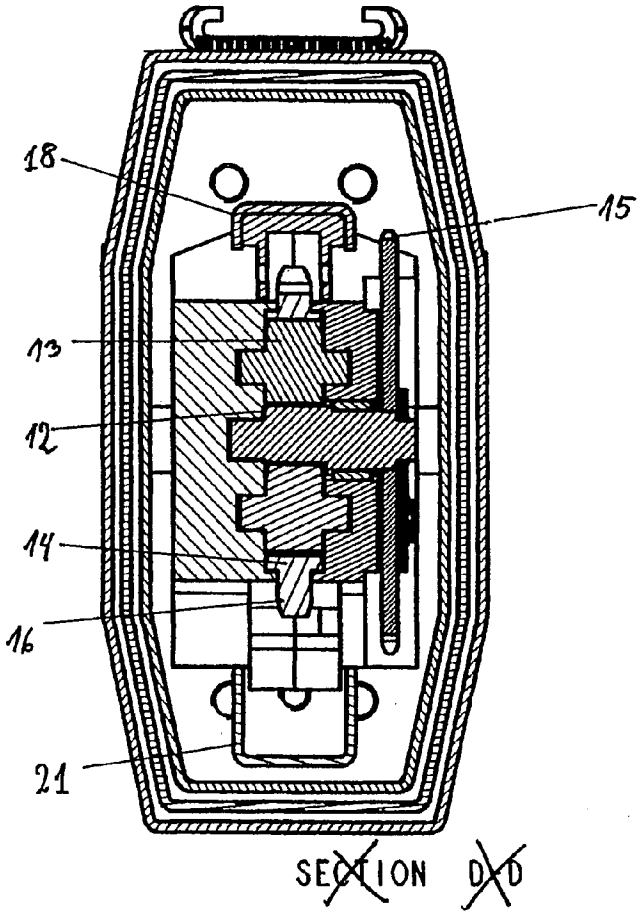
FIG. 5 shows a cross-section 5—5 of the column as shown in FIG. 3.
Figure 6:
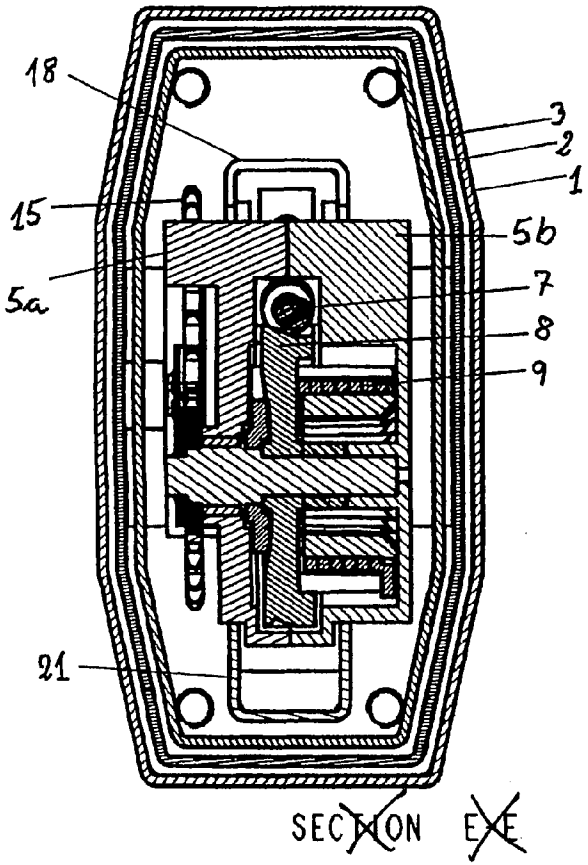
FIG. 6 shows a cross-section 6—6 of the column as shown in FIG. 3.

A drive device 4 as shown in FIG. 2 is mounted in the intermediate profile 2. This drive device is based on a stick-shaped element 5 consisting of two plastic shells 5*a*, 5*b*.

A DC motor 6 is secured to one end of the stick-shaped element 5, with an extension of the motor shaft constructed as a worm 7. The stick-shaped element mounts a shaft with a worm wheel 8 driven by the worm. A screw spring 9 is mounted on a cylindrical part of the worm wheel, said screw spring serving as a load moment barrier, cf. WO 98/30816, Linak A/S, see the spring and coupling parts positions 20–22 in the document.

A toothed wheel 10 for a drive chain 24 (shown in FIG. 7), which drives a planetary gear 11, is mounted on the same shaft as the worm wheel.

The planetary gear 11 with its such wheel 12 planet wheels 13 and internally toothed rim 14 is mounted in the stick-shaped element 5, i.e., the stick shaped element is locally formed as a housing for the planetary gear. A chain wheel 15 for the drive chain is mounted on the shaft of the sun wheel 12. The stick-shaped element is constructed such that the tooth rim slides on the plastics, so that the planet wheel just transfers moments and not lateral forces. The sun wheel is sintered and merges into a spline. The transition between the toothing and the spline is stepped in an inclined shoulder, there being inwardly provided a bushing which in turn carries a bearing. The use of the bushing allows the spline.

Figure 8:
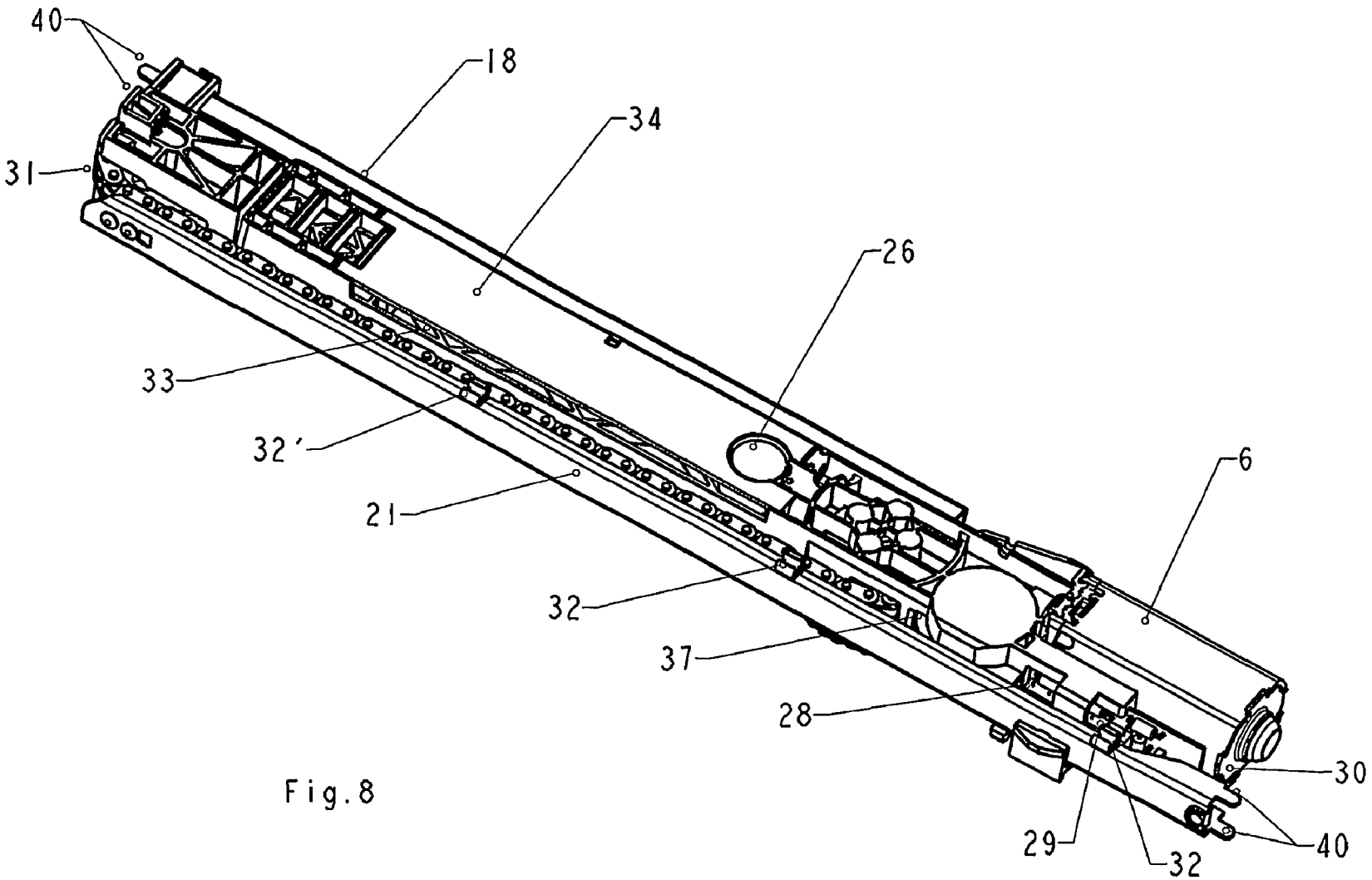
FIG. 8 shows the same as FIG. 7, seen from the other side.
Figure 9:
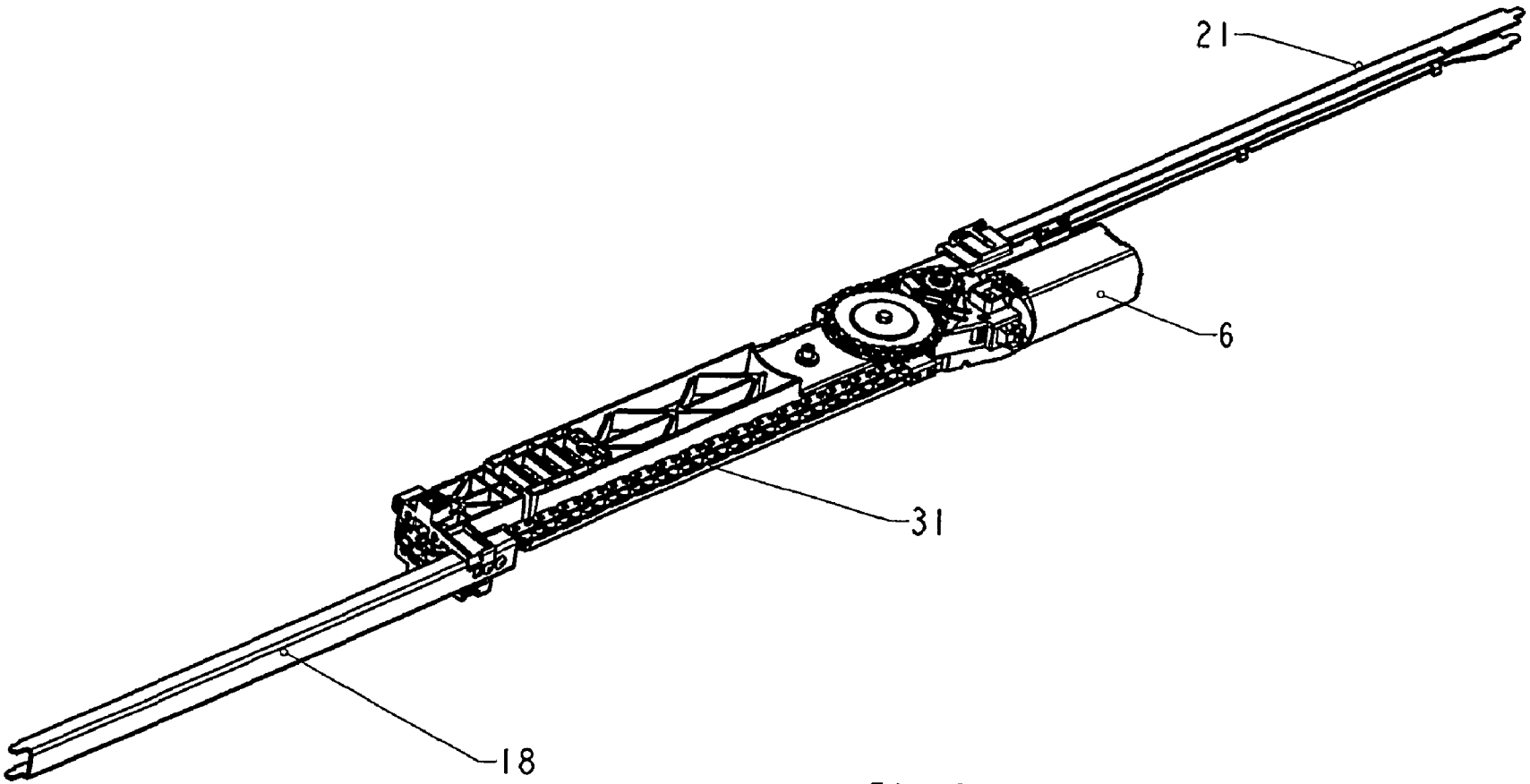
FIG. 9 shows the drive device of FIG. 7 in an extended position.

The toothed rim 14 is externally constructed as a chain wheel 16. It may be configured as a unit, e.g., in sintered metal, or joined as two independent units. A chain wheel 17 of a dimension similar to the chain wheel 16 is mounted at the other end of the stick-shaped element 5. A chain 31 (shown in FIGS. 8 and 9) runs around these two chain wheels 16, 17 and forms two parallel chain runs between the two chain wheels.

A rod 18 is mounted with its one end on the one chain run at the chain wheel 16, the other end of said rod being secured to the outer profile 1 via an end plate 20. A corresponding rod 21 is mounted on the other chain run at the chain wheel 17, but extends in the opposite direction and is secured with the other end to the inner profile 3 via an end plate 22. When the motor is activated, the two rods 18, 21, because of the movement of the chain, will extend the outer profile 1 and the inner profile 3, respectively, synchronously relative to the intermediate profile 2, and correspondingly retract them when the rotation of the motor is reversed.

The chain wheel 17 is mounted on a separate subelement 23 of the stick-shaped element. This subelement has a stem 23*a*, whereby it is received in a cavity at the end of the stick-shaped element. The end of the stem is inclined and cooperates with a wedge at the bottom of the cavity. The wedge may be adjusted to and fro by a screw for longitudinal displacement of the element 23 and thereby adjustment of the tightening of the chain.

With the transmission sequence: worm drive 7, 8, chain drive 10, 15 and planetary gear 11 as well as toothed wheel 16 externally on the toothed rim 14 of the planetary gear, a great reduction in the transmission is achieved. It is a further advantage that the gearing may easily be adjusted for current needs by changing the chain wheels 10, 15 of the chain drive.

The column has a relatively short mounting height as the motor is arranged in the area of the necessary overlap between the inner profile 3 and the intermediate profile 2. The specially constructed planetary gear 11 also contributes to reducing the mounting dimension.

As will appear, the mounting of the drive device is simple, as the various parts are mounted in one half of the stick-shaped element 5 and are subsequently closed by the other half, and finally the chain is tightened. The drive device is hereby ready for mounting in a column.

Figure 7:
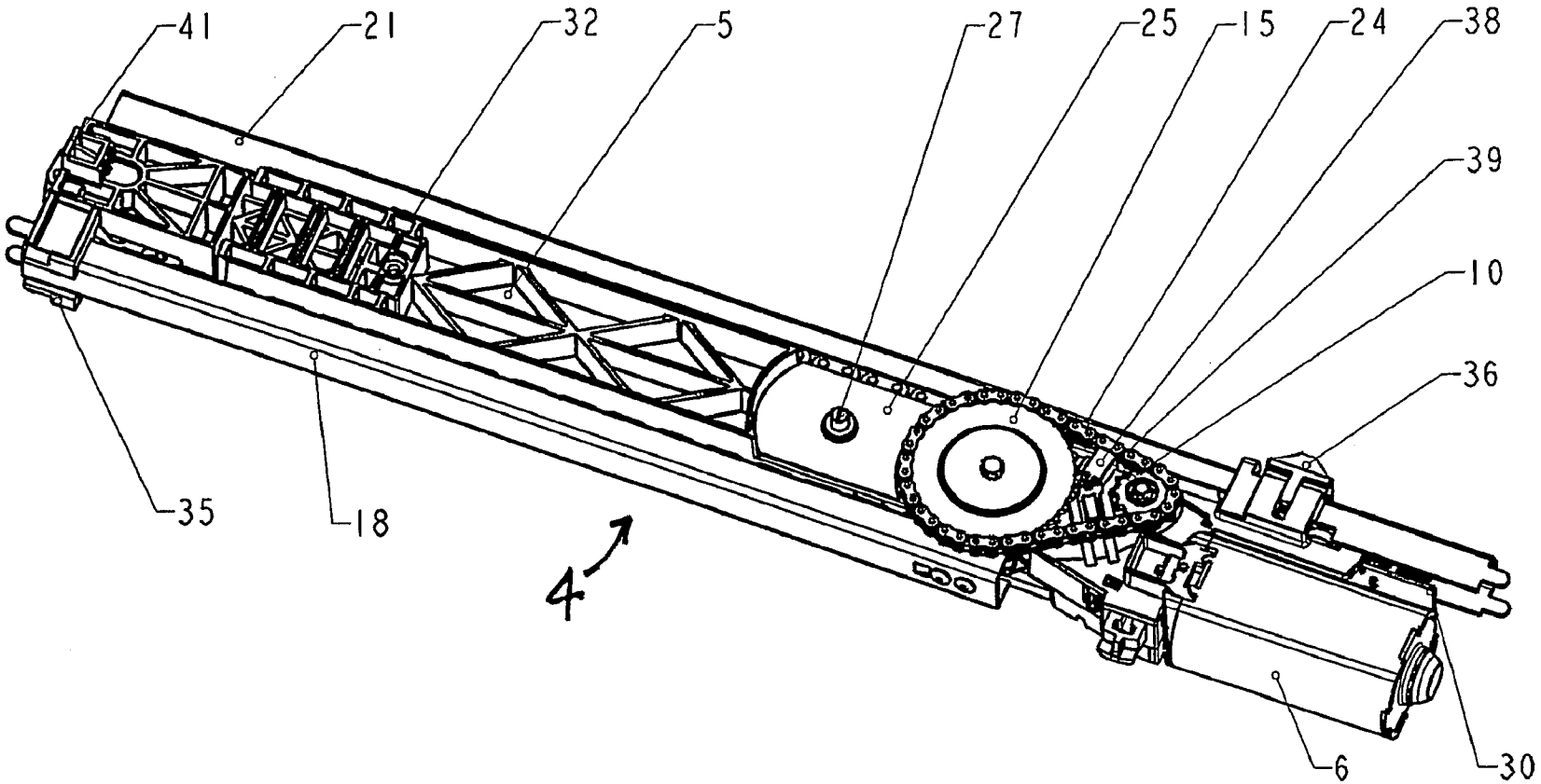
FIG. 7 shows a modified embodiment of a drive device useful in a lifting column, seen from one side.

FIG. 7 of the drawing shows a modified embodiment of the drive device, in which the same reference numerals are used as in the foregoing. In the modified embodiment, the stick-shaped element 5 is formed by a single element, and the housing for the planetary gear 11 and the other parts mounted in the stick-shaped element is formed by a space, which is subsequently closed by a cover 25. Provision has also been made for the mounting of a rotary potentiometer 26, if it is desired to have an absolute positional determination of the extended position of the drive device. The potentiometer is driven via a toothed wheel on the shaft 27 and is in engagement with the drive chain 24. Of course, other forms of positional determinations may be used, e.g. Hall sensors.

The end stop positions may be determined by two end stop switches 28, 29 mounted on a printed circuit board 30 which is inserted into a slot in the rod. The rods 18, 21 have a U-shaped cross-section which, with the sides, extends down around the chain 31. The side of the rod 21 is formed with a longitudinal incision for the keys of the end stop switches 28, 29. In the positions between the end stops the keys extend into the incision, but at the end stops the side of the rail will activate the respective end stop switch. Alternatively, the inner side of the rail might be equipped with a member for activation of the end stop switches.

Wiring for the motor and the end stop switches is introduced at the top of the column. It is typically a wire having at least four or five conductors. Since the motor and the end stop switches are positioned in the central member, the wire must have a freely movable excess length at least corresponding to the distance which the inner member may be extended. To avoid damage to the wire or the structure, the wire is secured to the rod 21 by means of wire holders 32. The wire is run with a curve into a chamber 33 in the stick-shaped element. This chamber is formed between the side of the stick-shaped element and a cover 34 and is open toward the rod 21 along the entire longitudinal side. In the retracted state, the wire extends from the cable holder 32' in a curve into the chamber at 33 and extends at the internal longitudinal side in the chamber up to the motor and the printed circuit board with the end stop switches. When the drive device is extended, the wire will be pulled along out through the side of the chamber 33. The wire is thereby controlled so that it is not damaged or does not cause operational disturbances by getting caught in the drive device or the column.

The outer end of the stick-shaped element has a guide 35 for the rod 18, and for the rod 21 there is a guide 36 which merely keeps the rod against the drive device. The rod 21 is guided in the lateral direction by a flange 37 on the stick-shaped element.

A special chain tightener is provided to prevent noise from the drive chain 24. The chain tightener comprises two blocks 38, where one end is intended for engagement with the chain, while the other end has a fin-shaped snap locking part intended for insertion into a slot in an upright boss 39. Only one block is shown in the drawing. The blocks are spring-loaded by a small spring for engagement with the chain. Prior to mounting, the two blocks are kept back on the boss 39. When the drive chain is mounted, the blocks are released for engagement with it. This facilitates the mounting and also ensures that the chain makes no noise.

The rods 18, 21 are riveted on a U-shaped link of the chain 31 and are secured with the other end to the inner member and the outer member, respectively, of the column by means of a pair of flaps 40. The flaps are inserted through a hole in an end plate in the members and are twisted about the longitudinal axis for attachment.

It is observed that the motor is secured to the stick-shaped element by a dovetail connection, said motor being provided with a front cover formed with a dovetail grove and a counterpart in the stick-shaped element, which is a simple configuration easy to mount.

For lateral guiding and positioning, the lower end of the stick-shaped element is provided with a boss 41 on each side which is supported against the inner side of the central profile when the drive device is inserted into it.

The term lifting column has been used in the foregoing, but it will be appreciated that the invention also covers linear actuators. A lifting column is fundamentally a linear actuator arranged vertically.

The invention claimed is:

1. A lifting column comprising first and second mutually telescopically slidable members and a drive device therefor, said drive device comprising a stick-shaped element which mounts first and second chain wheels at opposite ends thereof, said first chain wheel including a shaft, an endless first chain running over and between said first and second chain wheels to define a first chain run and a second chain run between the two chain wheels, said stick-shaped element at least in part extending between said first and second chain runs, an electric motor and a transmission mounted on the stick-shaped element, said transmission being directly connected to said electric motor and to said first chain wheel, separately from said endless first chain, to drive said first chain wheel and thus move said endless first chain along said first and second chain runs, and first connection means attached to said chain along said first chain run for moving one of said first and second slidable members, said electric motor being directly mounted on said stick-shaped element and fixedly positioned relative to said stick-shaped element.

2. A lifting column according to claim 1, wherein the stick-shaped element comprises two halves which may be assembled about a longitudinal plane.

3. A lifting column according to claim 1, wherein, in an area up to the motor, the stick-shaped element is formed with a recess for the transmission or a part thereof as well as for the first chain wheel.

4. A lifting column according to claim 1, wherein at least the second chain wheel most remote from the motor is mounted on a subelement of the stick-shaped element and is secured longitudinally slidably for tightening the chain.

5. A lifting column according to claim 1, wherein the transmission comprises a planetary gear having a toothed rim with an internal toothing in engagement with a planet wheel, which is in turn in engagement with a sun wheel, said toothed rim being externally configured as the first chain wheel.

6. A lifting column according to claim 5, wherein the stick-shaped element is locally configured as a housing for the planetary gear.

7. A lifting column according to claim 5, wherein the transmission additionally comprises a worm drive, wherein the motor shaft is formed with the worm.

8. A lifting column according to claim 7, wherein the worm drive and the planetary gear are connected with a second chain drive, said worm wheel being connected with a third chain wheel and the sun wheel with a fourth chain wheel.

9. A lifting column according to claim 8, including a chain tightener having at least one spring-loaded block, one end of the block being intended for engagement with the first chain, the other end having a snap locking part intended for cooperation with a boss for retention of the block against spring action, said block being caused to engage the first chain by the spring force when the snap locking part is released.

10. A lifting column according to claim 1, wherein the motor is secured to the stick-shaped element with a dovetail connection, said motor being provided with a front cover formed with a dovetail groove and a counterpart in the stick-shaped element.

11. A drive lifting column according to claim 1, including a rotary potentiometer for absolute positional determination of the extended position of the drive device, said potentiometer being arranged in a recess in the stick-shaped element and driven via a toothed wheel on the shaft and in engagement with the drive chain.

12. A lifting column according to claim 1, configured as a table leg for height-adjustable tables.

13. A lifting column according to claim 1, wherein said first connection means comprise a first rod.

14. A drive device for moving a movable element, comprising a stick-shaped element which mounts first and second chain wheels at oprosite ends thereof, said first chain wheel including a shaft, an endless first chain running over and between said first and second chain wheels to define a first chain run and a second chain run between the two chain wheels, said stick-shaped element at least in part extending between said first and second chain runs, an electric motor and a transmission mounted on the stick-shaped element, said transmission being directly connected to said electric motor and to said first chain wheel, separately from said endless first chain, to drive said first chain wheel and thus move said endless first chain along said first and second chain runs, first connection means attached to said chain along said first chain run for moving a first movable element, said electric motor being directly mounted on said stick-shaped element and fixedly positioned relative to said stick-shaped element, wherein said first connection means comprised a first rod, and including a second means connected to said second chain run to move a second movable element, said second means comprising a second rod.

15. A drive device according to claim 14, wherein said first and second movable elements are telescopic profiles.

16. A drive device according to claim 14, wherein at least one electrical wire leading to/from the drive unit is connected to one of the first and second rods.

17. A drive device according to claim 16, wherein the stick-shaped element has a cavity for receiving a length of said at least one wire in excess at any time, depending on an extended position of the drive unit.

18. A drive device according to claim 14, wherein end stop positions are determined by two end stop switches mounted on a common printed circuit board which may be inserted into a slot in the stick-shaped element.

19. A drive device according to claim 18, wherein the first and second rods are provided with means or are constructed themselves for activation of the end stop switches.

20. A drive device according to claim 14, wherein said first and second rods each have a U-shaped cross-section which, with the sides, extends along the sides of the first chain.

21. A drive device according to claim 20, wherein the side of one of the first and second rods is formed with a longitudinal incision for the function key of the end stop switches so that in the positions between the end stops the function keys extend into the incision, while at the end stops the side of the one rod will activate the respective end stop switch.

22. A drive device according to claim 14, wherein a guide is provided on each end of the stick-shaped element for the respective first and second rods.

23. A drive device according to claim 14, wherein the second rod is guided in a lateral direction by a flange on the stick-shaped element.

24. A drive device according to claim 20, wherein the first and second rods are riveted on a U-shaped link of the first chain.

25. A drive device according to claim 20, wherein the outer end of the first and second rods is formed with flaps for attachment in a structure in which the drive device is to incorporated.

26. A drive device for moving a movable element, comprising a stick-shaped element which mounts first and second chain wheels at opposite ends thereof, said first chain wheel including a shaft, an endless first chain running over and between said first and second chain wheels to define a first chain run and a second chain run between the two chain wheels, said stick-shaped element at least in part extending between said first and second chain runs, an electric motor and a transmission mounted on the stick-shaped element, said transmission being directly connected to said electric motor and to said first chain wheel, separately from said endless first chain, to drive said first chain wheel and thus move said endless first chain alone said first and second chain runs, first connection means attached to said chain along said first chain run for moving a first movable element, said electric motor being directly mounted on said stick-shaped element and fixedly positioned relative to said stick-shaped element, and wherein at least one end of the stick-shaped element is provided with at least a boss on each side as a lateral guide in a structure in which the drive device is to be incorporated.

* * * * *